United States Patent [19]

Faustini

[11] 4,172,251

[45] Oct. 23, 1979

[54] SELF-ENCODING KEY SWITCH AND KEYBOARD AND KEYBOARD SYSTEM UTILIZING THE SAME

[76] Inventor: Carlo Faustini, 13020 Tamarack Rd., Silver Spring, Md. 20904

[21] Appl. No.: 789,005

[22] Filed: Apr. 19, 1977

[51] Int. Cl.[2] ..... H01H 29/18; G08C 9/00

[52] U.S. Cl. ..... 340/365 A; 200/209; 200/191

[58] Field of Search ..... 200/191, 192, 208, 209, 200/214; 340/365 A, 365 E

[56] References Cited

U.S. PATENT DOCUMENTS

| | | | |
|---|---|---|---|
| 3,358,109 | 12/1967 | Schmid | 200/191 |
| 3,903,389 | 9/1975 | Faustini | 340/365 A |

*Primary Examiner*—Robert I. Smith

*Attorney, Agent, or Firm*—Robert H. Epstein

[57] ABSTRACT

A self-encoding key switch is formed of a body having a well for storing a pool of mercury, a plurality of contact chambers with encoding contacts therein and having channel portions communicating with the well of a size to resist flow of the mercury therethrough due to surface tension of the mercury, and a plunger movable into the well to force the mercury through the channel portions into the contact chambers to momentarily connect the encoding contacts thereby providing tactile feedback, self-encoding and N-key rollover. A keyboard system utilizes a plurality of the above-described self-encoding key switches along with a register, and a strobe contact is disposed in a contact chamber of each key switch such that the trailing edge of the signal from the strobe contact precedes the breaking of electrical connection between a supply contact in the body and the encoding contacts to trigger the register and enter coded data from the encoding contacts. A keyboard formed of a plurality of the above-described, self-encoding key switches is constructed with the bodies of each of the key switches formed of a single piece of plastic material mounted on a base member carrying electrical connectors forming the contacts in the key switches. In one embodiment, the electrical connectors are in the form of conductor bars extending through the base member which is integrally formed with the switch bodies as a single unit. In another embodiment, the base member has surface carried connectors in the manner of a printed circuit board.

21 Claims, 14 Drawing Figures

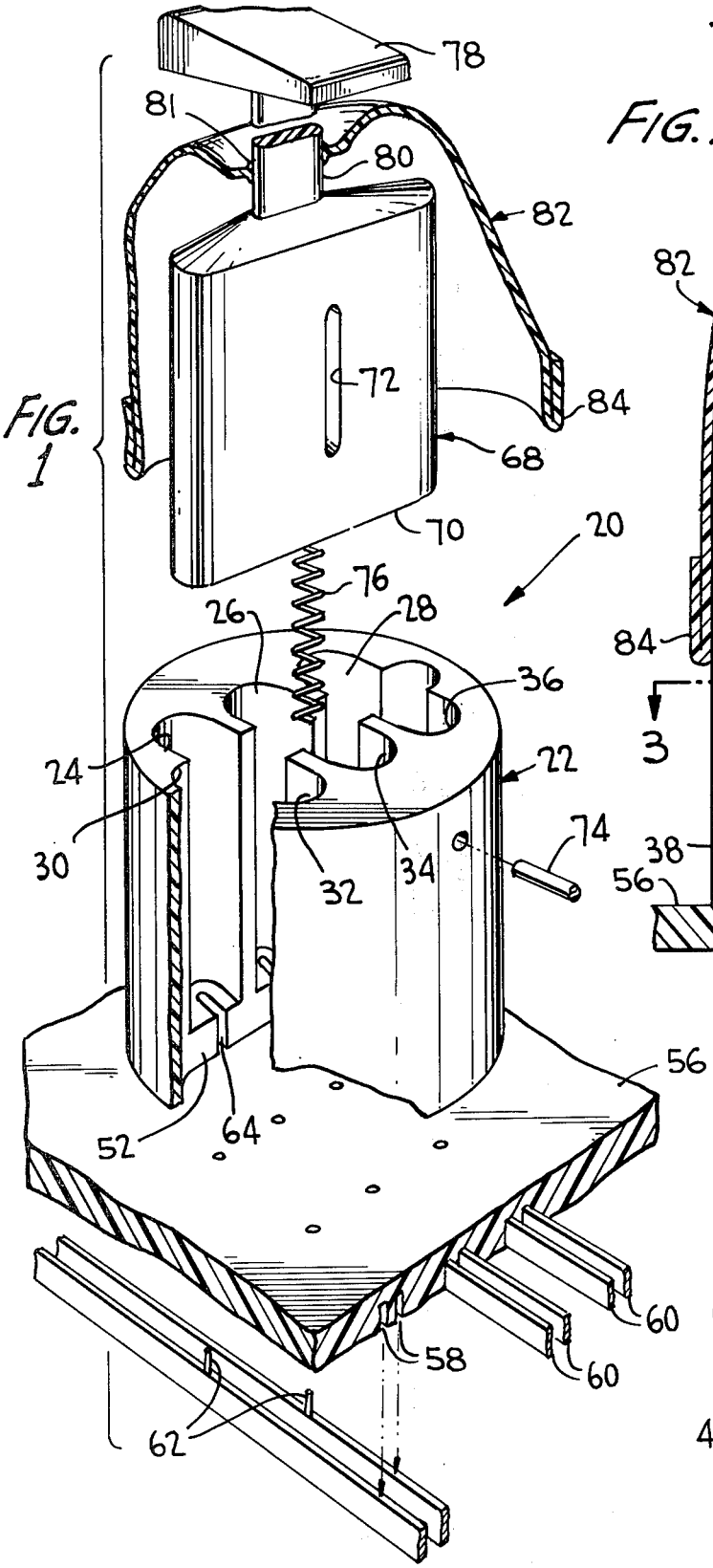
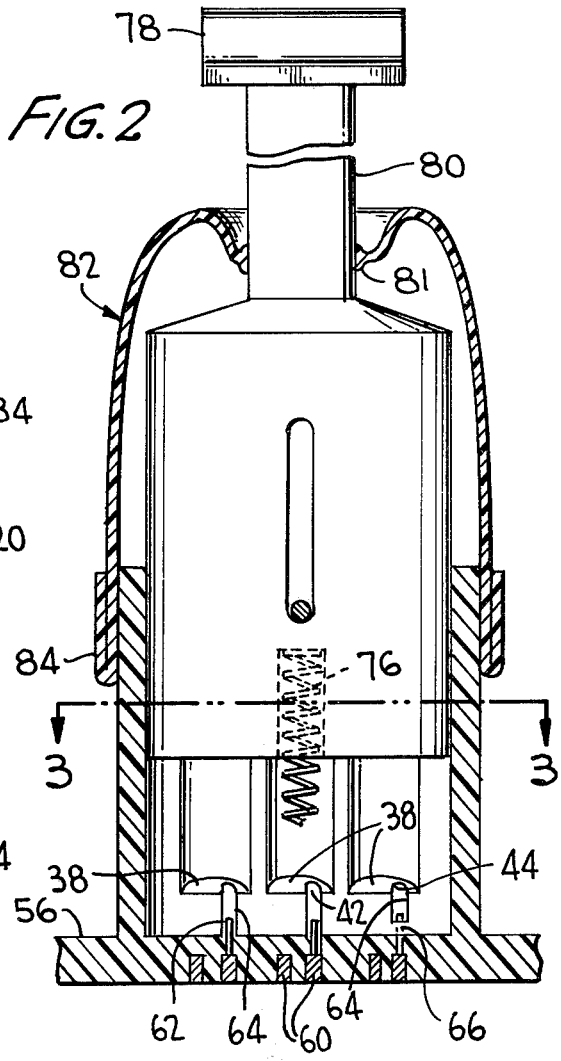
FIG. 3
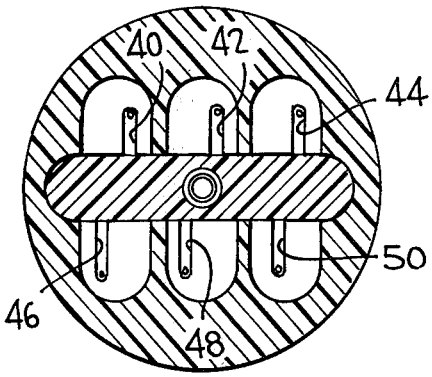

SELF-ENCODING KEY SWITCH AND KEYBOARD AND KEYBOARD SYSTEM UTILIZING THE SAME

BACKGROUND OF THE INVENTION

1. Field of the Invention

The present invention pertains to electrical key switches and, more particularly, to self-encoding key switches for use with data-entry keyboard systems.

2. Discussion of the prior art

Due to the rapid growth of the computer, information handling and data processing industries, the demand for low cost, reliable keyboards and keyboard systems for data-entry is increasing since keyboards provide a natural and convenient interface between human operators and the electronic equipment. To this end, keyboards are familiar input devices for computers and peripheral equipment thereof, calculators, display devices and general communication terminals.

The heart of a keyboard is the individual key switches which are actuated by an operator to generate corresponding coded electrical signals. Key switches for use with keyboards can generally be classified in two major categories; that is, contact and non-contact switches. In contact key switches, a physical contact must be established, such as in reed, cross bar, elastomeric, mercury-filled tube, magnetic repulsion and coil spring, cross-point switches, to name a few. Non-contact switches do not require such physical contact and include Hall-effect, capacitive-coupled, saturating magnetic core and photoelectric switches, to name a few. Most contact key switches produce only a simple make or break signal, such as a contact closure, to provide an output voltage or a change of value of some electrical parameter (resistance, capacitance or inductance); and, for this reason, keyboards utilizing such key switches require, in addition to the appropriate number of key switches, electronic circuitry for converting or encoding the key switch signals into desired acceptable codes, for matching the interface characteristics of the associated electronic equipment and for providing N-key rollover to overcome the problem of erroneous signal transmission caused during burst speed key depression when previously struck keys remain depressed while additional keys are depressed. Some non-contact key switches have overcome some of the disadvantages of contact key switches; however, such non-contact key switches have the disadvantages of being relatively expensive and requiring standby power.

Accordingly, it is desirable for key switches to provide the features of N-key rollover and self-encoding; and, further, it is desirable for key switches to provide tactile feedback to the operator in that such tactile feedback essentially duplicates the feel of electric typewriters due to the key force increasing with key displacement until the moment of switch closure whereat the force of pressure drops suddenly. Another desirable feature in key switches is the strobe function which operates to signal the associated electronic equipment that an encoded output has been obtained.

Since key switches and the electronic circuitry for use therewith represent a substantial portion of the cost of keyboards and keyboard systems, many attempts have been made to reduce the electronic circuitry requirements as well as to reduce the cost of the key switches. These attempts in the prior art have not been successful in that attempts to provide self-encoding key switches to reduce circuitry costs have utilized non-contact type switches and, therefore, have increased switch costs while attempts to reduce the cost of key switches have required electronic encoding circuitry and, frequently, additional circuitry to match one type of interface circuit with another thereby increasing electronic circuitry costs. Attempts to develop low cost, self-encoding key switches utilizing a plurality of mechanical contacts have suffered the disadvantages of contact bounce and the inability to economically provide long life, high reliability and N-key rollover.

U.S. Pat. No. 3,903,389 to Faustini discloses a contact key switch overcoming the above disadvantages of the prior art by utilizing mercury to momentarily connect a supply contact with a plurality of encoding contacts and a strobe contact to provide tactile feedback, self-encoding and N-key rollover. While the mercury key switch of the Faustini patent represents a great improvement over the prior art, there is still a need to improve such mercury key switches to facilitate manufacture and assembly of keyboards using the same.

SUMMARY OF THE INVENTION

The present invention is an improvement of the mercury key switch of U.S. Pat. No. 3,903,389 and overcomes the abovementioned disadvantages of the prior art by being inexpensive to produce, providing self-encoding, tactile feedback and N-key rollover and having long life and high reliability while being capable of direct interfacing with any type of electronics.

It is a primary object of the present invention to facilitate the producing of keyboards by utilizing a plurality of mercury key switches which can be manufactured as a single unit.

Another object of the present invention is to produce a self-encoding key switch obviating the requirement for electronic encoding circuitry in a keyboard.

The present invention has a further object in the construction of an inexpensive, self-encoding key switch formed of plastic components and utilizing a pool of mercury displaceable by a plunger through small channels into a plurality of contact chambers to provide momentary connection between a supply contact and a plurality of encoding contacts in the chambers, the channels having a size to resist flow of mercury therethrough due to surface tension of the mercury.

An additional object of the present invention is to provide a data entry-keyboard system formed of a plurality of self-encoding key switches manufactured as a single unit, each switch having supply, encoding and strobe contacts therein adapted to be momentarily connected by an electrically conductive liquid, and a register having data inputs connected with selected ones of the encoding contacts of each key switch and a strobe input connected to the strobe contact of each key switch such that actuation of any of the key switches enters coded data directly into the register.

Yet a further object of the present invention is to provide a plunger and a body of a key switch with configurations such that a pool of mercury is forced by the plunger in a piston-like manner through a plurality of contact chambers into a relief chamber thereby providing tactile feedback and N-key rollover, the contact chambers having a size to prevent free flow of mercury therein due to surface tension of the mercury such that the surface tension and the momentum from movement of the plunger cause the mercury to pass through the contact chambers in a single movement to provide only a momentary electrical connection.

The present invention has another object in that an electrical key switch is provided with contact chambers having channel portions communicating with a well for storing mercury, the channel portions having a size to resist free flow of the mercury therethrough due to surface tension of the mercury. A plunger is movable into the well to overcome the resistance of the channel portions and force the mercury therethrough to momentarily contact electrical contacts disposed in the contact chambers.

Yet an additional object of the present invention is to construct a keyboard of a plurality of electrical key switches operable by a plunger acting on mercury in a well to force the mercury into contact chambers in which encoding contacts are disposed and a base member mounting the plurality of key switches and having connectors extending therealong for connection with preselected ones of the encoding contacts of each of the key switches.

Some of the advantages of the present invention over the prior art are that the key switches of the present invention can be simply and inexpensively produced as a single unit while providing tactile feedback, self-encoding and N-key rollover features, and a keyboard system utilizing key switches according to the present invention can be inexpensively produced due to the lack of a requirement for electronic circuitry for encoding and matching with various interfaces.

The present invention is generally characterized in an electrical key switch including a body having a well for storing an electrically conductive liquid and a contact chamber having a channel portion communicating with the well, the channel portion of the contact chamber having a size to resist free flow of the liquid therethrough due to surface tension of the liquid; an electrical contact extending into the contact chamber; and a plunger movable into the well to force the liquid through the channel portion into the contact chamber to momentarily contact the electrical contact. The present invention is further generally characterized in a keyboard and keyboard system utilizing the above-described key switches.

BRIEF DESCRIPTION OF THE DRAWINGS

FIG. 1 is a broken exploded view of a key switch according to the present invention.

FIG. 2 is a vertical section of the key switch of FIG. 1.

FIG. 3 is a section taken along line 3—3 of FIG. 2.

DESCRIPTION OF THE PREFERRED EMBODIMENT

Figure 4:
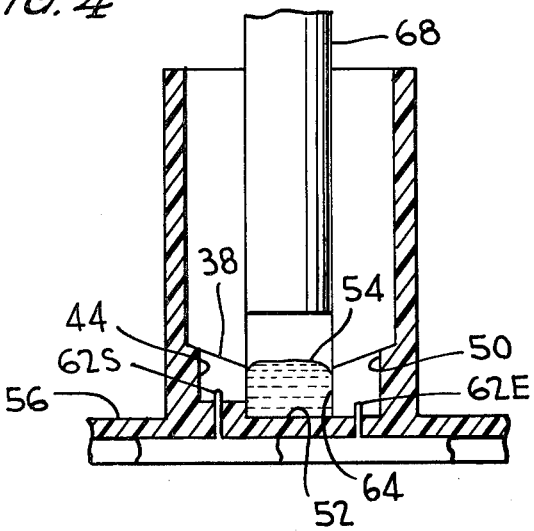
FIGS. 4, 5, 6, 7 and 8 are vertical sections illustrating the operation of the key switch of FIG. 1.

A key switch 20 according to the present invention is illustrated in FIGS. 1, 2 and 3 and includes a body 22 made of a plastic material and having an outer cylindrical configuration with longitudinal recesses 24, 26 and 28 arranged along one side of a longitudinal channel 30 and longitudinal recesses 32, 34 and 36 arranged along the other side of channel 30. The recesses 24, 26, 28, 32, 34 and 36 terminate at their lower ends at inwardly and downwardly sloping surfaces 38, and contact chambers 40, 42, 44, 46, 48 and 50 are formed in the body 22 in communication with recesses 24, 26, 28, 32, 34 and 36, respectively, at the sloping surfaces 38. The bottom of the channel 30 forms a well 52 for receiving a pool of electrically conductive liquid, such as mercury 54, the bottom wall of the well 52 being formed by a flat base member 56 having grooves 58 therein for receiving elongate, electrically conductive connector bars or ribbons 60 having tips 62 protruding therefrom to extend through the member 56 and into the contact chambers, as best shown in FIG. 2. While the body 22 and the base member 56 are illustrated in FIG. 1 as being separate parts to facilitate understanding of the present invention, the body and the base member are preferably integrally formed in one piece, as shown in FIG. 2, such that an entire keyboard formed of a plurality of key switches 20 can be manufactured as a single unit.

The contact chambers are each formed with channel portions 64 of a cross sectional size to resist free flow of the electrically conductive liquid, the channel portions being formed at the mouths of the contact chamber to communicate with the well 52 to provide a path for the electrically conductive liquid from the well to the electrical contacts 62 disposed in the contact chambers. By resisting "free" flow is meant that the electrically conductive liquid is precluded from flow through the channel portions under normal ambient condition without some outside force such that an additional force or pressure must be applied to the liquid to force it to pass through the channel portions. The channel portion 64 for the contact chamber 44 does not extend to the bottom of the well 52 but rather is blocked by a wall 66 such that the electrical contact in contact chamber 44 defines a strobe contact to supply a strobe pulse, as will be explained hereinafter. The recesses 24, 26, 28, 32, 34 and 36 disposed above the contact chambers form relief chambers to return the liquid 54 to the well after actuation of the key switch, and it will be appreciated that the relief chambers need not be separate, but could be formed as a single chamber.

A plunger 68 for the key switch 20, preferably made of a plastic material, has an oblong configuration in cross section and is adapted to be movable in channel 30 such that a bottom edge 70 thereof extends into the well 52. The plunger has a slot 72 centrally located therein to receive a pin 74 for holding the plunger within the body 22, and a return spring 76 is recessed in the bottom 70 of the plunger to provide a return force for the plunger. A key top 78 is secured to the plunger 68 via a stem 80, and a cap 82 of resilient material, such as plastic or rubber, is secured to the stem 80 at a bead 81 at its upper end and has a bead 84 on its lower end secured to the body 22 to seal the plunger within the body. The cap 80 may be secured to the plunger and the body in any suitable manner, such as by ultrasonic welding, and the resilient nature of the cap provides a return force for the plunger capable of obviating the need for return spring 76.

The operation of the key switch 20 will be described with respect to FIGS. 4–8 wherein it can be seen that, initially, the mercury 54 is disposed in a pool in the well 52 in sufficient quantity such that the top level of the mercury is at substantially the same level as the inner edge of the sloping surfaces 38 at the bottom of the relief chambers, as shown in FIG. 4. With the plunger 68 in its raised position away from the well 52 under the force from return spring 76 and cap 82, the mercury will remain in the well since the cross sectional size of the channel portions 64 is such as to preclude free flow of the mercury therethrough and, in effect, prevent free flow of mercury without pressure applied thereto. Accordingly, no electrical connections are made between a supply contact and the encoding electrical contacts or the strobe electrical contact. For purposes of illustration, the electrical contact in contact chamber 50 is given the reference number 62E to denote its use as an encoding contact while the electrical contact in contact chamber 44 is given the references number 62S to denote its use as the strobe contact. An electrical supply contact connected with a supply potential can be mounted at any suitable position in the body 22, for example in one of the contact chambers or on the bottom wall of well 52. For the sake of simplicity, FIGS. 4–8 are staggered sections illustrating only the operation of the strobe contact chamber 44 and one of the other contact chambers 50, it being appreciated that all of the remaining contact chambers operate in the same manner as contact chamber 50.

Figure 5:
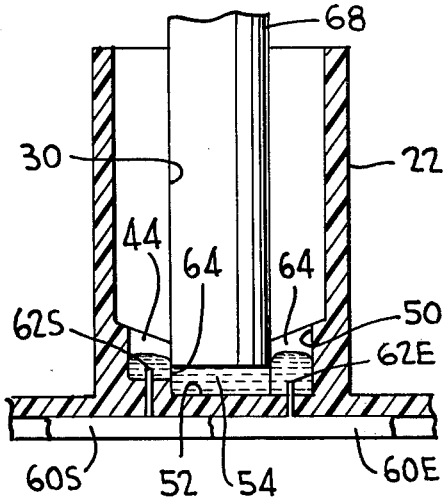

When the key switch is actuated by pressure on key top 78, the plunger 68 is axially moved into the body 22 in substantial sealing engagement with the walls defining channel 30 such that the pool of mercury 54 cannot exit the well 52 into the relief chambers but can only flow through the channel portions 64 into the contact chambers, the force of the plunger 68 overcoming the surface tension of the mercury 54 to permit flow through the channel portions. As shown in FIG. 5, when the plunger 68 is depressed, the mercury will be forced into contact chambers 44 and 50 to electrically connect encoding contact 62E and strobe contact 62S with the contacts disposed in the other contact chambers, one of such contacts being the supply contact, it being appreciated that the quantity of mercury is sufficient to extend through the channel portions from the well to the contact chambers to electrically connect the supply contact with the encoding and strobe contacts. Accordingly, an electrical connection will be established between the supply contact and the encoding contacts 62E and the strobe contact 62S.

Figure 6:
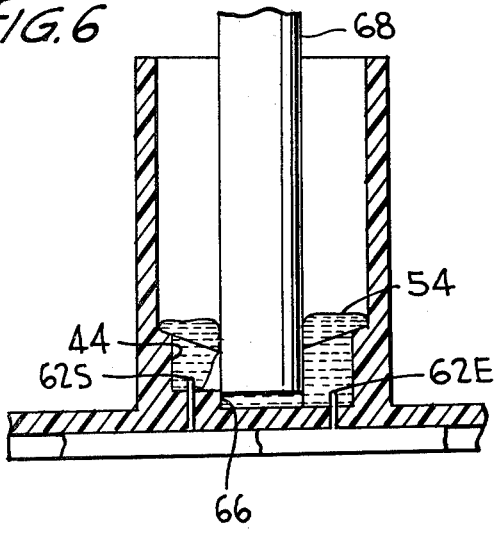

Once the plunger 68 has been depressed sufficiently to engage the wall 66 limiting the depth of the channel portion of the contact chamber 44 for the strobe contact 62S, the electrical connection with the strobe contact will be broken while the electrical connection between the supply contact and the encoding contacts 62E remains, as shown in FIG. 6. In this manner, a strobe signal having a trailing edge is created which, as will be discussed relative to FIG. 9, can be utilized in a storage register to enter data corresponding to the connected encoding contacts. As is shown, the mercury 54 is already collecting in the relief chambers from the contact chambers in that the mercury is squeezed through the contact chambers with continuous flow due to its surface tension and momentum from depression of the plunger 68.

Figure 7:
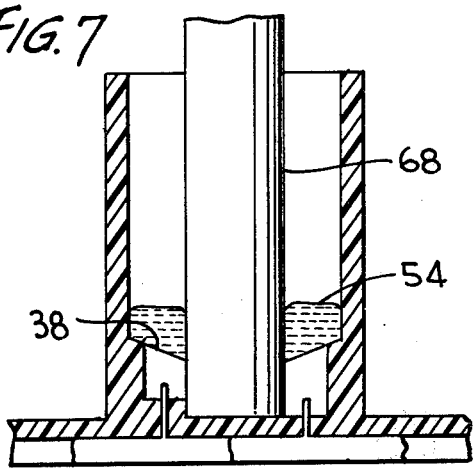
Figure 8:
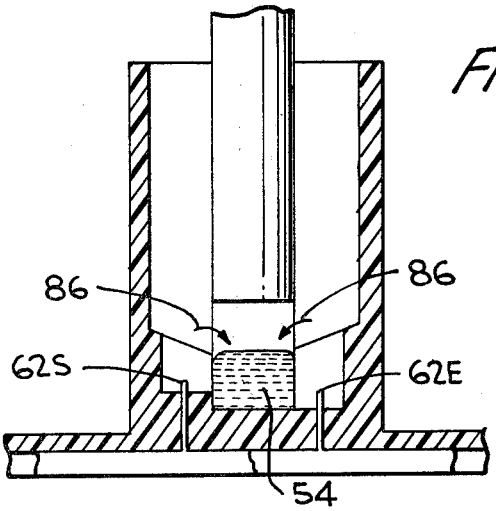

In FIG. 7, the plunger 68 is shown at the bottom of its downward stroke blocking passage of mercury 54 therethrough whereby electrical connection between the various contacts is interrupted, the mercury 54 being squeezed upward out of the contact chambers into the relief chambers thereabove such that once the plunger commences its upward or return stroke, the mercury will move down the sloping surfaces 38 to return to the well 52, as shown in FIG. 8, as indicated by arrows 86. Since the mercury passes through the contact chambers to the overlying relief chambers, once the operator has moved the plunger 68 to the end of its downstroke, tactile feedback is provided by release of the mercury pressure. Additionally, it will be noted that by disconnecting the encoding contacts at the bottom of the plunger stroke, the electrical contact is only momentary thereby providing N-key rollover with the encoding contacts producing signals in accordance with any data a particular key switch is designed to transmit. To this end, it is noted that electrical encoding contacts 62E are positioned only in the contact chambers required to produce a desired code for a key switch with the remaining contact chambers having no electrical contacts disposed therein. Of course, any number of contact chambers could be utilized with the key switch 20 to provide more or less complex codes.

Figure 9:
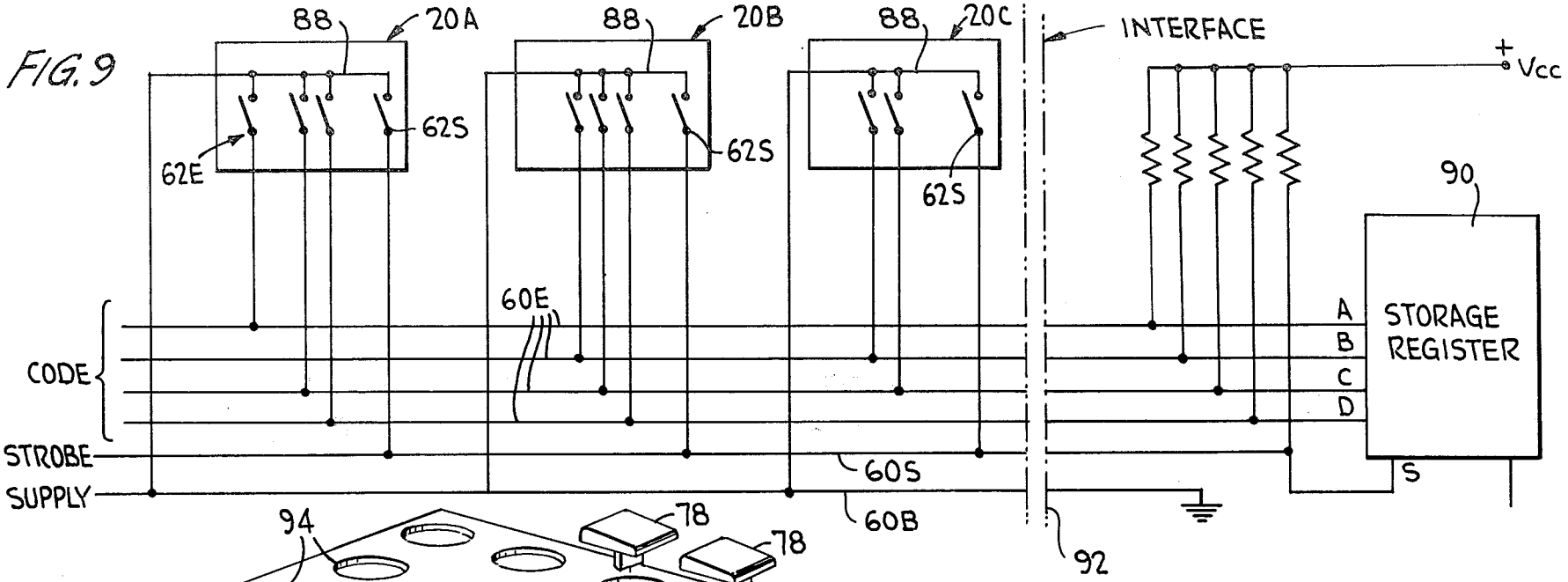
FIG. 9 is a schematic diagram of a keyboard system utilizing key switches according to the present invention.

A keyboard system according to the present invention is illustrated schematically in FIG. 9 where only three key switches 20A, 20B and 20C are illustrated, each of the key switches having the structure described above with respect to key switch 20. The supply contact 88 of each of the key switches is connected to a supply potential, such as ground or any other positive or negative reference potential, by means of a common bus connector bar 60B; and, similarly, the strobe contacts 62S of each key are connected with a common strobe connector bar 60S. Common encoding contacts 62E are similarly connected with common connector bars 60E, and the connector bars are electrically connected to supply data input to a storage register 90 which will normally be part of the electronic equipment with which the keyboard is to be used and is connected with the keyboard via a suitable interface 92. The strobe input S of the storage register is connected with the strobe contact 62S of each of the key switches via connector bar 60S while data inputs A, B, C and D of the storage register receive data from connector bars 60E. Preselected ones of the encoding contacts 62E of each of the key switches are connected to desired connector bars 62E in accordance with the desired input data to be supplied by each key switch. No encoding contacts not required for the coded data to be supplied by each key switch will be disposed within that key switch such that all contact chambers need not have an electrical contact disposed therein. Each of the data and strobe inputs is connected via a suitable resistor to a positive voltage source Vcc such that each of the inputs to the storage register has a positive potential thereon when no key switch is depressed. For example, it will be seen that only three encoding contacts are utilized with key switches 20A and 20B, and these contacts produce a different code for each switch while key switch 20C uses only two encoding contacts.

In operation, each time a key switch is actuated, the supply contact will be connected with all of the encoding contacts within the key switch to place the supply potential on selective ones of the connector bars 60E for input to the storage register 90. For example, when key switch 20A is actuated, the ground potential from connector 60B will be supplied to the first, third and fourth connector bars 60E; and, thus, data inputs A, C and D of the storage register will be at ground potential or low input while the remaining data input B will be at Vcc or high input. Similarly, ground potential will be supplied via the strobe contact 62S to connector bar 60S; and, upon the trailing edge of the strobe signal, the strobe contact being the first to be disconnected, the storage register 90 will be triggered to enter the coded data signals from the encoding contacts 62E of the actuated key switch. In similar fashion, when key switch 20B is actuated, data inputs B, C and D will be low, and data inputs B and C will be low when key switch 20C is actuated.

Since the mercury 54 is squeezed through the contact chambers as the plunger 68 is depressed, only momentary connection between the supply contact and the encoding and strobe contacts is established to provide N-key rollover in that even if one or more key switches are held down, the held key switches will not interfere with the strobing and encoding of data from later actuated key switches. Furthermore, the encoded data from each key switch will be automatically strobed into the storage register without any timing circuitry to provide the strobe function due to the disconnection of the strobe contact before the disconnection of the encoding contacts thereby creating a trailing edge for the strobe signal for sensing coded data from the still connected encoding contacts.

Figure 10:
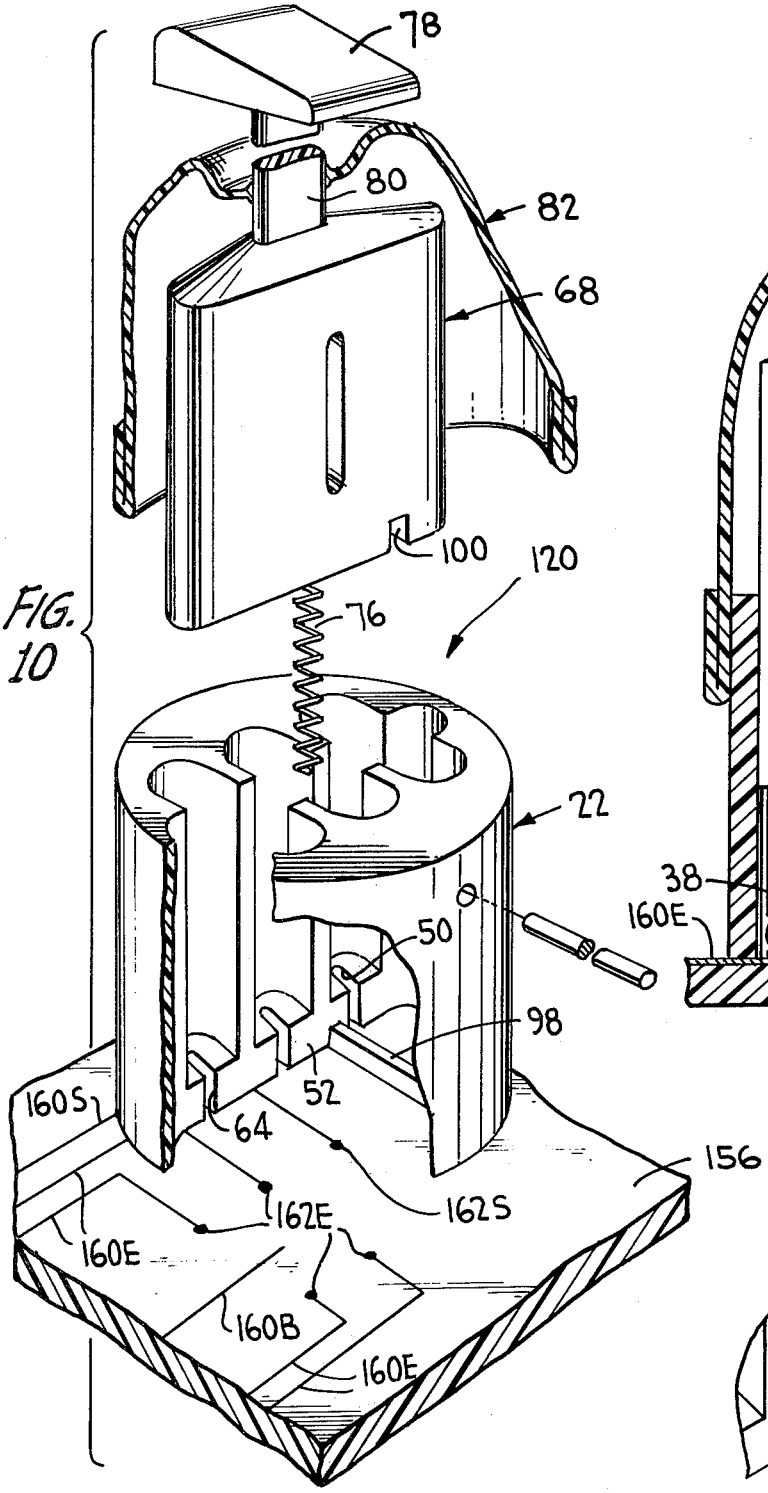
FIG. 10 is a broken exploded view of a modification of the key switch of the present invention for use with printed circuit boards.
Figure 11:
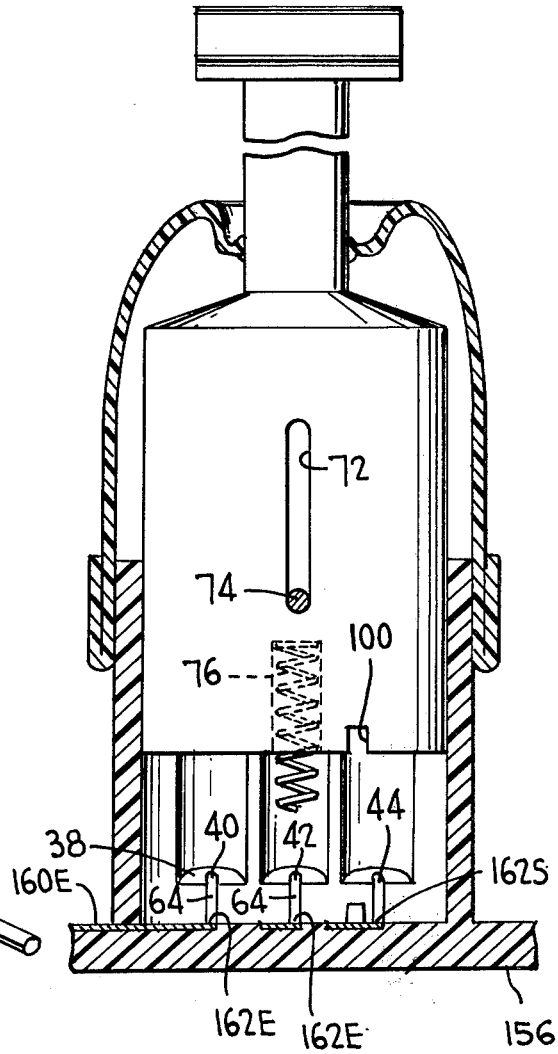
FIG. 11 is a vertical section of the key switch of FIG. 10.

A modification of a key switch 120 of the present invention for use with printed circuits boards is illustrated in FIGS. 10 and 11 and parts thereof identical to parts of the key switch 20 of FIG. 1 are given the same reference numbers and not described again while parts similar to parts of the key switch 20 of FIG. 1 are given the same reference numbers with 100 added.

As shown in FIGS. 10 and 11, a base member 156 is formed of a printed circuit board having connectors 160E on one or both surfaces thereof terminating at 162E to define encoding contacts for the key switch 120. A strobe connector 162S, and a connector 160B extends between the encoding contacts to define the supply contact. The body 22 has a barrier 98 extending across the well 52 to partition the strobe contact chamber 50 from the encoding contact chambers, and the plunger 68 has a notch 100 formed in its bottom wall in registration with the partition 98. The contacts 162 are aligned with the contact chambers so as to be towards the back such that the channel portions 64 of the contact chambers define a path for the flow of mercury 54 to establish connection with the contacts 162. A plurality of the key switches 120 can be integrally formed of a single piece of plastic overlying a large printed circuit board 156, as shown in FIG. 12.

The operation of the key switch 120 is similar to that described above with respect to key switch 20 with the exception that the strobe feature is produced by the partition 98 receiving the notch 100 in the plunger to disconnect the strobe from the supply contact prior to disconnection of the supply contact and the encoding contacts. In this manner, the storage register will be triggered by the trailing edge of the strobe signal to receive the coded low input data from the supply connector 160B via the encoding contacts 162E and the connectors 160E.

Figure 13:
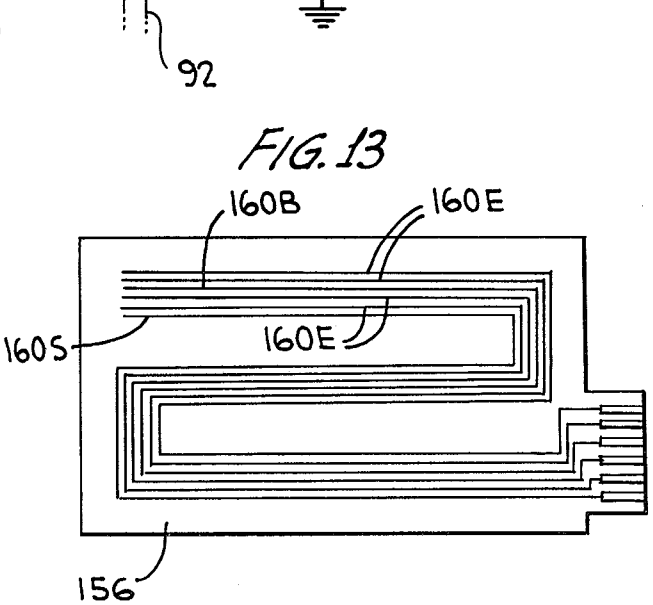
FIG. 13 is a plan view of a printed circuit board utilized with the keyboard of FIG. 12.
Figure 12:
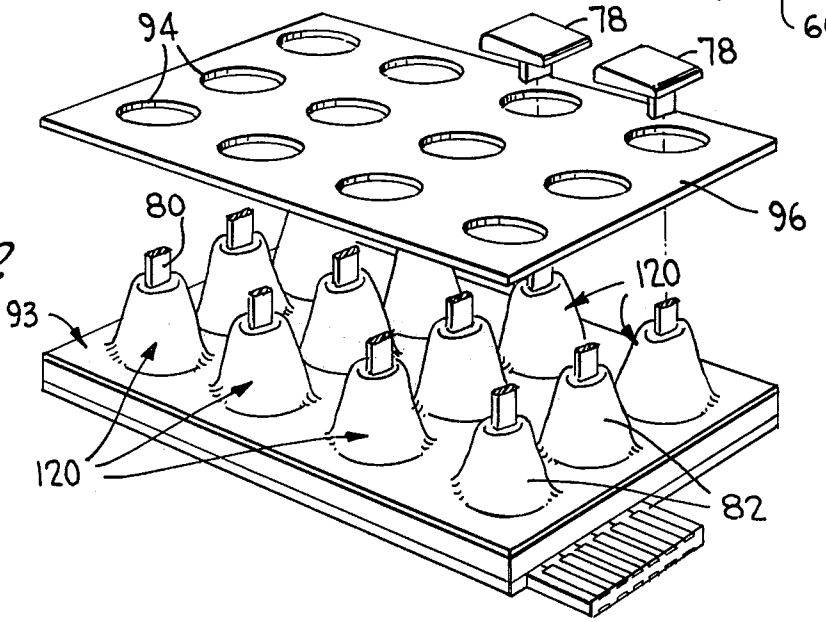
FIG. 12 is an exploded view of a keyboard utilizing the key switches of FIG. 10.

A keyboard formed of twelve key switches 120 according to the present invention is illustrated in FIG. 12, it being appreciated that the connectors for all of the key switches are formed on a single printed circuit base member 156 and the bodies 22 of all of the key switches are formed as a single unit in a piece of plastic 93 and welded to the member 156 with the contacts 162 properly positioned to form the encoding, supply and strobe contacts for each key switch. The caps 82 are also formed of a single piece of resilient material to cover each of the key switches, the stems 80 of the key switches 120 extend through corresponding holes 94 in a keyboard top 96, and the key tops 78 are secured to the stems on the exterior of the top 96. The base member 156 is constructed in the manner of a conventional printed circuit board with the connectors 160 carried on one or both surfaces thereof and arranged such that all of the connectors extend under each key switch 120 to permit the positioning of contacts 162 at the required locations to provide coded data for each individual key switch, as shown in FIG. 13, the connectors terminating at a connector plug for connection to suitable circuitry for processing the keyboard data.

The embodiment of FIGS. 10 and 12 has the advantage that it can be implemented using a printed circuit board while requiring only three basic component parts, the printed circuit board, the piece 93 forming the bodies of the key switches and the piece of material forming the caps 82, plus the stems 80 which could also be integrally formed with interconnecting webs to permit movement of one stem without movement of the other stems. The embodiment of FIGS. 1 and 2 has the additional advantage that the base member and the piece forming the bodies of the key switches can be made as a single integral unit thereby reducing the number of component parts even further. Of course, any suitable plastic forming method can be used to form the bodies of a plurality of key switches according to the present invention of a single piece of plastic.

Figure 14:
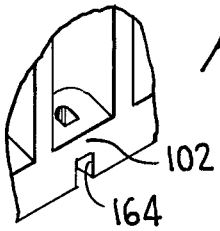
FIG. 14 is a broken view of a modification of the contact chamber channel portions of the key switches of FIGS. 1 and 2.

A modification of the channel portions of the contact chambers is illustrated at 164 in FIG. 14 and has a tunnel-like configuration rather than an open channel, as shown at 64 in key switches 20 and 120. The tunnel effect is formed by a wall 102 which serves to concentrate the force on the mercury 54 to force it to the back of the contact chamber.

The configuration of the body of the key switch of the present invention can be altered to suit various applications and to accommodate any required number of encoding, timing and supply contacts. Similarly, more than one contact can be located in any contact chamber, and the contact chambers can have various configurations to enhance flow of mercury therethrough as well as to accommodate a plurality of contacts, it being important only that the mouth or channel portions of the contact chambers be of a size to resist free flow of the electrically conductive liquid therethrough due to the surface tension of the liquid. For mercury, it is desirable that the width of the channel portion be between 0.010 to 0.020 inches and preferably between 0.013 and 0.017 inches.

Inasmuch as the present invention is subject to many variations, modification and changes in detail, it is intended that all subject matter discussed above or shown in the accompanying drawings be interpreted as illustrative and not in a limiting sense.

What is claimed is:

1. An electrical key switch comprising body means including well means, a pool of electrically conductive liquid stored in said well means, contact chamber means having channel means communicating with said well means, and relief chamber means disposed over said contact chamber means for receiving said liquid from said contact chamber means and returning said liquid to said well means, said channel means having a cross sectional size to preclude free flow of said liquid therethrough due to surface tension of said liquid, said pool of liquid being of sufficient quantity to extend from said well means through said channel means to said contact chamber means;

electrical contact means positioned in said contact chamber means; and plunger means movable into said well means to force said liquid to pass through said channel means into said contact chamber means and into said relief chamber means for return to said well means to momentarily contact said electrical contact means.

2. An electrical key switch as recited in claim 1 wherein said contact chamber means includes a plurality of contact chambers and said electrical contact means includes a supply contact mounted in said body means and a plurality of encoding contacts each mounted in one of said contact chambers whereby movement of said plunger means into said well means electrically connects said encoding contacts with said supply contact.

3. An electrical key switch as recited in claim 2 wherein said plunger means is movable along said channel means to block passage of said liquid therethrough and interrupt the electrical connection of said supply and encoding contacts.

4. An electrical key switch as recited in claim 3 wherein each of said contact chambers has a channel portion of a cross sectional size to preclude free flow of said liquid therethrough.

5. An electrical key switch as recited in claim 4 wherein one of said channel portions includes a wall to block passage of said liquid therethrough before the other channel portions are blocked to produce a strobe signal.

6. An electrical key switch as recited in claim 4 wherein said body means has a barrier formed in said well means separating one of said contact chambers from the remaining contact chambers and said plunger means has a notch aligned with said barrier to block passage of said liquid to said one contact chamber before said channel portions for the other contact chambers are blocked to produce a strobe signal.

7. An electrical key switch as recited in claim 4 wherein said electrically conductive liquid is mercury and said body means is constructed of a plastic material.

8. An electrical key switch as recited in claim 7 wherein said body means includes a body and a base member integrally formed as a single unit and said electrical contact means includes a plurality of connector bars extending along said base member having upwardly extending tips protruding through said base member into said contact chambers to form said strobe and encoding contacts.

9. An electrical key switch as recited in claim 7 wherein said body means includes a body mounted on a printed circuit base member and said electrical contact means includes connectors disposed on the surface of said base member and terminating at positions aligned with said contact chambers to form said strobe and encoding contacts.

10. An electrical key switch as recited in claim 4 wherein said relief chamber means includes a plurality of relief chambers, each disposed over one of said contact chambers and having an inwardly and downwardly sloping bottom surface to receive said liquid from said contact chambers when said plunger means is depressed and return said liquid to said well means when said plunger means returns to a position above said well means.

11. An electrical key switch as recited in claim 1 wherein said relief chamber means has a downwardly sloping bottom surface for returning said liquid to said well means when said plunger means returns to a position spaced from said well means.

12. An electrical key switch as recited in claim 1 wherein said channel means has a tunnel-like configuration.

13. A keyboard system comprising a plurality of electrical key switches each formed of a body defining a well, a pool of electrically conductive liquid stored in said well, a plurality of contact chambers communicating with said well via channel means having a cross sectional size to preclude free flow of said liquid therethrough due to surface tension of said liquid, and relief chamber means disposed over said contact chamber means for receiving said liquid from said contact chamber means and returning said liquid to said well, said pool of liquid being of sufficient quantity to extend from said well through said channel means to said contact chambers, a plurality of electrical contacts including strobe and encoding contacts each disposed in one of said contact chambers and a supply contact, and plunger means movable into said well to force said liquid through said channel means into said contact chambers and into said relief chamber means for return to said well to momentarily connect said electrical contacts;

register means having a plurality of data inputs and a strobe input;

means connecting each of said supply contacts of said key switches with a supply potential;

a plurality of data connector means each connected with one of said data inputs of said register means, predetermined ones of said encoding contacts of each of said key switches being connected with predetermined ones of said connector means; and strobe connector means connecting each of said strobe contacts of said key switches with said strobe input of said register means whereby actuation of any of said key switches produces coded data signals on said encoding contacts and a strobe signal on said strobe contact to enter said coded data signals into said register means.

14. A keyboard system as recited in claim 13 wherein each of said key switches includes wall means for said channel means adjacent said contact chamber in which said strobe contact is disposed to disconnect said strobe contact from said supply contact prior to disconnection of said encoding contacts from said supply contact and said register means is responsive to the trailing edge of the strobe signal to enter the coded data signals in said register means.

15. A keyboard comprising a plurality of electrical key switches each including a body having well means, a pool of electrically conductive liquid stored in said well means, and contact chamber means communicating with said well means for receiving said liquid from said well means, electrical contact means disposed in said contact chamber means to define a plurality of encoding contacts, and plunger means movable into said well means of force said liquid into said contact chamber means to connect said encoding contacts;

a single base member mounting said plurality of key switches and defining a bottom wall for the body of each of said key switches; and connector means extending along said base member for connection with preselected ones of said encoding contacts of each of said key switches.

16. The keyboard as recited in claim 15 wherein said connector means includes conductive bars extending along said base member with transversely extending tips protruding into said contact chamber means of said key switches to form said encoding contacts.

17. The keyboard as recited in claim 16 wherein said bodies of said plurality of key switches are all formed from a single piece of plastic material.

18. The keyboard as recited in claim 17 wherein said base member is unitarily formed with said piece of plastic material forming said bodies of said plurality of key switches.

19. The keyboard as recited in claim 16 wherein said connector means is carried on a surface of said base member defining said bottom walls for said key switches and terminates at positions aligned with said contact chamber means to define said encoding contacts.

20. The keyboard as recited in claim 19 wherein said bodies of said plurality of key switches are all formed from a single piece of plastic material.

21. The keyboard as recited in claim 16 wherein said contact chamber means includes channel means communicating with said well means having a cross sectional size to preclude free flow of said liquid therethrough due to surface tension of said liquid.

* * * * *